United States Patent [19]

Loescher

[11] Patent Number: 4,492,946

[45] Date of Patent: Jan. 8, 1985

[54] EDGE-ACTUATED THERMOSTAT

[75] Inventor: Michael R. Loescher, Mansfield, Ohio

[73] Assignee: Therm-O-Disc, Incorporated, Mansfield, Ohio

[21] Appl. No.: 543,619

[22] Filed: Oct. 20, 1983

[51] Int. Cl.[3] ..... H01H 37/54

[52] U.S. Cl. ..... 337/365; 337/343; 337/349; 337/372

[58] Field of Search ..... 337/365, 349, 343, 89, 337/53, 372

[56] References Cited

U.S. PATENT DOCUMENTS

| | | | |
|---|---|---|---|
| Re. 26,406 | 6/1968 | Bolesky | 337/354 |
| Re. 28,019 | 5/1974 | Schmitt | 337/347 |
| 2,954,447 | 9/1960 | Bolesky et al. | 337/354 |
| 3,197,594 | 7/1965 | Schmitt | 337/348 |
| 3,248,501 | 4/1966 | Hire | 337/354 |
| 3,322,920 | 5/1967 | Morris | 337/365 |
| 3,451,028 | 6/1969 | Schmitt | 337/343 |
| 3,537,052 | 10/1970 | Snider | 337/354 |
| 3,541,488 | 11/1970 | Odson | 337/13 |
| 3,601,741 | 8/1971 | Holden | 337/380 |
| 3,621,434 | 11/1971 | Gerich | 337/348 |
| 3,660,793 | 5/1972 | Them et al. | 337/348 |
| 3,852,698 | 12/1974 | Schmitt et al. | 337/354 |
| 4,367,452 | 1/1983 | Carlson | 337/365 |

*Primary Examiner*—Harold Broome

*Attorney, Agent, or Firm*—Pearne, Gordon, Sessions, McCoy, Granger & Tilberry

[57] ABSTRACT

A snap acting thermostat is described which is suitable for miniature construction and utilizes a thermostatic snap acting disc, one edge of which actuates the contacts. The force of the thermostatic disc forces the contacts closed in one temperature condition by acting on the contact end of the contact strip, the entire length of which is resilient. This permits sufficient movement of the contacts for usable voltage and current ratings without excessive metal fatigue in the physically short contact strip.

19 Claims, 5 Drawing Figures

EDGE-ACTUATED THERMOSTAT

BACKGROUND OF THE INVENTION

A number of thermostats have been designed to give a snap action rather than a creep action by the temperature change of a thermostat element, and many of these snap acting thermostats have utilized a thermostatic disc. A few have been of a first type to utilize the force of the disc to close the electrical contacts in the thermostat, and these include U.S. Pat. No. 2,954,447, issued Sept. 27, 1962 to J. D. Bolesky et al; U.S. Pat. No. 3,197,594, issued July 27, 1965 to Donald J. Schmitt; U.S. Pat. No. 3,248,501, issued Apr. 26, 1966 to C. J. Hire; and U.S. Pat. No. 3,451,028, issued June 17, 1969 to Donald J. Schmitt. In the second-mentioned of the foregoing patents, the current flow was through the metallic disc. In the third of these patents, the design was a double-throw contact switch, and hence inherently in one of the two throw positions of the disc, force was used to close the contacts. A more usual design was found in a second type wherein the force of the thermostatic disc was used to open the contacts rather than to close them, and this design is shown, for example, in U.S. Pat. No. 4,367,452, issued Jan. 4, 1983 to Richard H. Carlson.

In a few thermostat designs, an attempt has been made to achieve a longer resilient contact strip than the space permitted within the thermostat housing. Examples of this third type of thermostat are found in U.S. Pat. No. RE 26,406, issued June 11, 1968 to John D. Bolesky. in U.S. Pat. No. 3,621,434, issued Nov. 16, 1971 to Anton J. Gerich, and in U.S. Pat. No. 4,367,452, supra. In a fourth type of thermostat, the resilient contact strip has a hinge portion closely adjacent the mounting end of the contact strip, is actuated by application of force at a point outboard of the hinge, and at an area of the contact strip which has no substantial flexing, established, e.g., by stiffening ribs. This fourth type of thermostat is illustrated in U.S. Pat. No. 3,537,052, issued Oct. 27, 1970 to Harold F. Snider; U.S. Pat. No. 3,601,741, issued Aug. 24, 1971 to Ronald L. Holden; and U.S. Pat. No. RE 28,019, issued May 28, 1974 to Donald J. Schmitt. Many other thermostats are of this type, but because the use of stiffening ribs was so common, many of the thermostat patent drawings did not bother to disclose them.

A fifth type of prior art thermostat is one wherein an edge of the thermostatic disc is that which is used to actuate the contact strip. This type of thermostat is illustrated in U.S. Pat. No. 3,322,920, issued May 30, 1967 to Rexford M. Morris; U.S. Pat. No. 3,541,488, issued Nov. 17, 1970 to Clifford S. Odson; U.S. Pat. No. 3,660,793, issued May 2, 1972 to Edward G. Them et al; and U.S. Pat. No. 3,852,698, issued Dec. 3, 1974 to Donald J. Schmitt.

These various prior art designs have not solved the problem of how to establish a miniature thermostat which is a snap acting thermostat, wherein the maximum dimension thereof is less than $\frac{3}{8}$ inch. Such a thermostat may utilize a thermostatic disc for maximum snap acting force developed in such a small area, yet the prior art designs have been ones wherein it was exceedingly difficult to achieve sufficient contact separation in the open circuit condition to provide a satisfactory thermostat which had sufficient voltage and current ratings and sufficient cycles of operation to be a marketable thermostat.

SUMMARY OF THE INVENTION

This problem is solved by a thermostat comprising, in combination, a base, a metal cap mounted on said base to form an enclosure therewith, first and second terminals mounted on said base in a manner insulated from each other and each having one end extending into said enclosure, a fixed contact on said one end of said first terminal, a resilient contact strip having a mounting end and a contact end, means mounting said mounting end on said one end of said second terminal within said enclosure, a movable contact on said contact end of said contact strip and adapted to cooperate with said fixed contact, said contact strip having a resilient bias away from said fixed contact, first and second supports on said base, a thermostatic snap element having two positions of stability mounted on said two supports and on said contact end of said contact strip for a three-point support, and a convex projection on the inside of the top of said cap adapted to engage a convex central region of said thermostatic element in one temperature condition thereof to establish contact pressure forcing said movable contact against said fixed contact, and whereby upon temperature change beyond a predetermined temperature said thermostat will snap to a condition concave toward the inside of said cap for an open circuit condition of said contacts as established by the resiliency of said contact strip.

The problem is further solved by a thermostat comprising, in combination, a base, a fixed contact mounted on said base, a resilient contact strip having a mounting end and a contact end, means mounting said mounting end of said contact strip on said base in a manner insulated from said fixed contact, a movable contact mounted on said contact end of said contact strip and adapted to cooperate with said fixed contact, said contact strip having an inherent bias away from said fixed contact, a thermostatic snap element having two positions of stability and mounted relative to said base and having at least a two-point support near the perimeter of one surface thereof with one point of said support being the contact end of said contact strip, and fixed abutment means carried on said base and acting against the central convex region of the other surface of said thermostatic element to establish said movable and fixed contacts in the closed contact condition at temperatures on one side of the operating temperature range of the thermostat, said closed contact condition being established by the force of the edge of said bimetallic element against the bias of said contact strip.

This problem is still further solved by a miniature thermostat having a first contact mounted on a base and a resilient contact strip with a mounting end on the base and a movable contact mounted on the opposite contact end, a thermostatic snap element having two positions of stability mounted relative to said base and having at least a two-point support near the perimeter of one surface thereof, and fixed abutment means carried on said base and acting against the central region of the other surface of said thermostatic element, the improvement comprising substantially the entire length of said contact strip outboard of said mounting means being resilient and deformable, one point of said support of said thermostatic element being the contact end of said contact strip to bend substantially the entire length of said contact strip by an edge of said thermostatic element, and one position of stability of said thermostatic element urging said contacts closed against the spring bias of said contact strip.

Accordingly, an object of the invention is to provide a miniature thermostat utilizing a thermostatic disc of less than 0.3 inch in diameter but which will achieve sufficient contact separation for useful voltage and current ratings.

Another object of the invention is to provide a snap acting thermostat wherein the entire length of the contact strip is resilient and is actuated by an edge of a thermostatic element.

Other objects and a fuller understanding of the invention may be had by referring to the following description and claims, taken in conjunction with the accompanying drawing.

DESCRIPTION OF THE PREFERRED EMBODIMENTS

Figure 1:
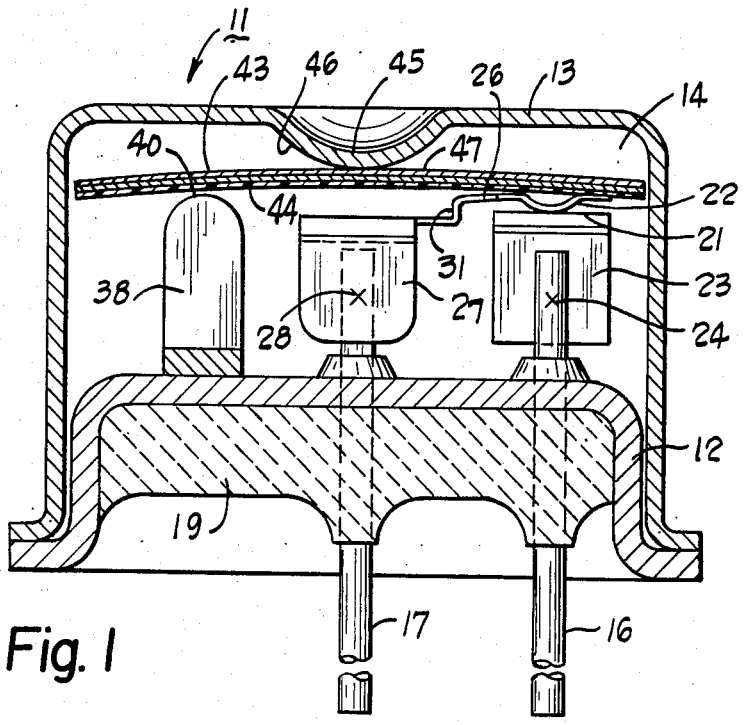
FIG. 1 is a broken sectional view of a thermostat embodying the invention, taken along the line 1—1 of FIG. 2.
Figure 2:
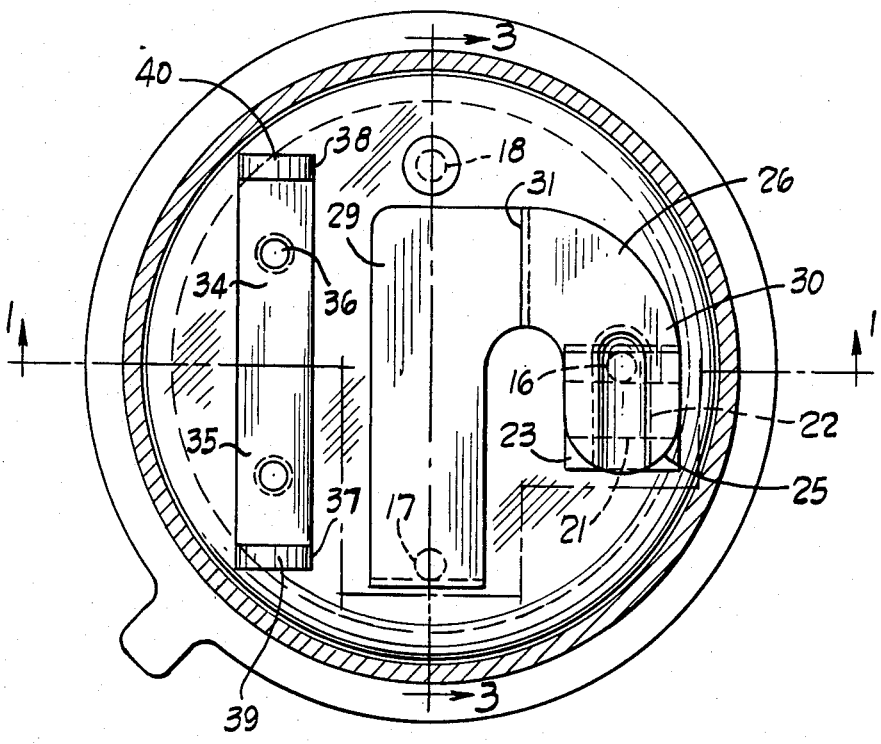
FIG. 2 is a plan view of the thermostat of FIG. 1, with the cap cut away and thermostatic disc removed.
Figure 3:
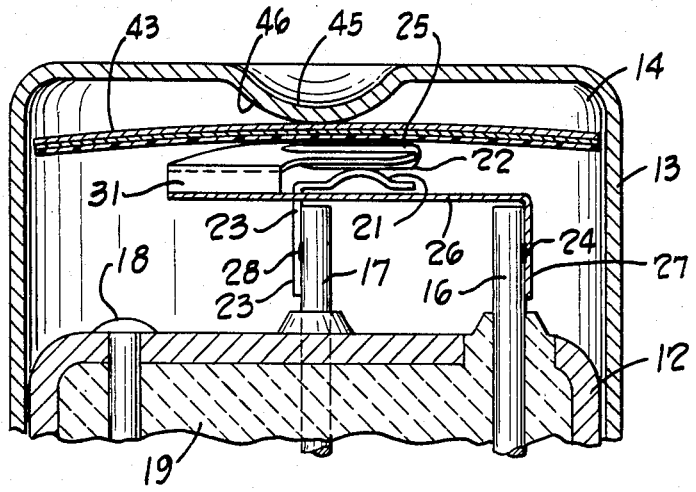
FIG. 3 is a sectional view on line 3—3 of FIG. 2.

FIGS. 1, 2, and 3 illustrate a thermostat 11 which has a base 12 and a cap 13 on the base, which, together with the base, provide an enclosure 14 for the thermostat 11. In the preferred embodiment of FIGS. 1–3, the base 12 is a metal base, e.g., Kovar, and the cap 13 is also metal, with nickel preferred. With these two parts of metal, it is a feature of the invention that the thermostat 11 is hermetically sealed, e.g., by soldering or welding. Alternatively, the cap 13 may be secured to the base 12, as by a press fit, and an adhesive.

The base 12 includes first, second, and third terminals 16, 17, and 18, respectively, each of which extends through the base 12 and is mounted therein. The first and second terminals 16 and 17 are mounted in an insulated manner on the base 12, and to this end an insulator material 19 substantially fills the underside of the base 12 and supports and insulates the terminals 16 and 17 from the metal base 12. The third terminal 18 is an optional terminal, and is a ground terminal by being secured to the base 12, as shown in FIG. 3. External to the thermostat 11, the first, second, and third terminals have a length sufficient to engage appropriate apertures in a printed wiring board and to extend through that printed wiring board to be wave-soldered on the underside of the board to mount the thermostat to such board. Hence, the thermostat may be utilized to provide high limit temperature protection to the circuit components of the printed wiring board.

Inside the enclosure 14 a first or fixed contact 21 is provided mounted on the first terminal 16, and a second contact 22 is provided, mounted on the second terminal 17. The first contact 21 is shown as a partially cylindrical ridge on a relatively rigid contact piece 23, which is welded at 24 to the inboard end of the first terminal 16. The second contact 22 is also shown as a partially cylindrical deformed portion at a contact end 25 of a contact strip 26. This contact strip 26 has a mounting end 27 which is welded at 28 to the inboard end of the second terminal 17. The contact strip 26 is generally of a J-shape, with a long leg 29 containing the mounting end 27 and a short leg 30 terminating in the contact end 25. The contact strip 26 has a Z-shaped bend 31 at the junction between the long and short legs, in order to elevate the contact end 25 above the mounting end 27.

A U-shaped metal support 34 has the base part 35 thereof secured as by welding 36 to the base 12. This metal support 34 has first and second upstanding legs 37 and 38, respectively, which terminate in first and second fixed supports 39 and 40, respectively.

A thermostatic snap acting element 43 is provided in the thermostat 11 to relatively actuate the contacts 21 and 22. This thermostatic snap acting element is shown as a disc, and typically may be a bimetallic disc. An optical insulator disc 44 is provided underneath the thermostatic disc 43.

At least two points of support are provided for the thermostatic disc 43, support 39 and the contact end 25 of the contact strip 26. These support points are on opposing semicircles of the perimeter of disc 43. Actually, for stability, a three point support is provided by the first and second supports 39 and 40, and on the contact end 25 of the contact strip 26. The three points of support are each in a different 120° arc of the disc perimeter. Without the provision of the insulator disc 44, the thermostatic disc would rest directly on these three supports, but with the provision of the insulator disc 44, the first and second contacts 21 and 22 are insulated from the metal cap 13. The insulator disc 44 may be made of any suitable material, such as polyimide, which has good insulating properties even though it is quite thin. The thermostatic disc has two positions of stability, one on either side of an intermediate snapping position, the two positions of stability establishing the contact closed and contact open conditions.

A convex projection 46 is provided on the base 12, and conveniently in this embodiment is provided on the underside or inside of the cap 13, and is adapted to engage a convex central region 47 of the thermostatic disc 43 in one of the two positions of stability of the thermostatic disc 43.

It will be noted that the one point of support of the thermostatic disc 43 which is at the contact end 25 of contact strip 26, is on the side of that contract strip opposite the movable contact 22.

In operation, the thermostat 11 may be used as a high limit temperature protective device for a printed wiring board, and may be mounted directly to such printed wiring board by having the terminals 16, 17, and 18 extend through apertures in the board and be electrically connected to the circuit thereon, e.g., by wave soldering. The thermostat has a sufficiently small area and volume so as to be compatible with other components on the printed wiring board. For example, the cap 13 is of the same approximate size as a TO5 transistor housing, with the dimension across the outermost diameter being 0.358 inch and the height of the cap and base exclusive of the external terminals being 0.235 inch. This permits a maximum diameter of the bimetallic or thermostatic disc 43 of 0.295 inch, which is exceptionally small for a thermostatic device.

The thermostat 11 is shown as one which opens on a rise of temperature, and in FIG. 1, contacts 21 and 22 are shown in the normally closed condition, such as might occur at room temperature. Upon a rise in temperature past the predetermined operating temperature, the thermostatic disc 43 will snap through the intermediate position to the opposite position of stability whereat the thermostatic disc 43 is concave toward the inside of the cap 13. In the position shown in FIG. 1, it is the edge of the thermostatic disc 43 which engages the outermost edge of the contact end 25 of the contact strip 26. The contact strip has an inherent resilient bias away from the first or fixed contact 21, and when the thermostatic disc 43 snaps to its opposite stable condition, the resilient bias of the contact strip 26 opens the contact 22 relative to contact 21. In the position shown in FIG. 1, it is the force of the edge of the thermostatic disc 43, counteracted partially by the inherent bias of the contact strip 26, which forces contact 22 into engagement with the first contact 21.

The three-point support of the thermostatic disc 43 is established by the first and second supports 39 and 40 and the outer edge of the contact end 25 of the contact strip 26. When the thermostatic disc snaps to the opposite stable position, this support of the thermostatic disc establishes the maximum separation of the contacts 21 and 22. Even in this miniature size, a contact separation of 0.002 to 0.005 inch is achieved. This separation, plus the good contact closing force established by the thermostatic disc 43 in the position of FIG. 1, establishes a rating of 35 volts and 1 ampere, with life of at least 100,000 cycles of operation.

One factor in the good performance of the thermostat 11 is the fact that substantially the entire length of the contact strip is resilient and is bent or stressed by actuation from the thermostatic disc 43. In fact, the point of actuation by the thermostatic disc is outboard of the movable contact 22, so that the entire length of this contact strip is deflected downwardly toward the first contact 21 in the position shown in FIG. 1. This is extremely important in a miniature thermostat where the effective length of this contact strip 26 is substantially only about 0.30 inch long. The contact strip 26 does not have any stiffening ribs in any portion thereof, which ribs are common in many of the prior art thermostats and would limit the resilient deformation of the contact strip as effected by the thermostatic element.

The thermostat 11 may be readily calibrated after assembly. The cap 13 may be placed on the completed thermostat mounted on the base 12, and the flange of the cap welded to the flange of the base 12. Then, the thermostat may be placed in a temperature-regulated bath, brought to operating temperature, and then a central, concave depression 45 may be formed or enlarged in the top of the cap 13 to increase the amount of the convex projection 46 until the thermostat snaps to an open circuit condition. The springback of the convex projection 46 may be taken into consideration by depressing the central depression 45 a little more, as experience dictates. As an alternative, the calibration may be achieved by having a press fit between the cap 13 and base 12, and utilizing a preformed, central, cocave depression 45. In this case, the thermostat is placed in the temperature control bath, such as an air bath, and the cap 13 pushed onto the base 12 until the open circuit condition is encountered. The push-on of the cap 13 will be terminated at this point, and the cap 13 secured in that position by adhesive or other suitable means, such as soldering.

Figure 4:
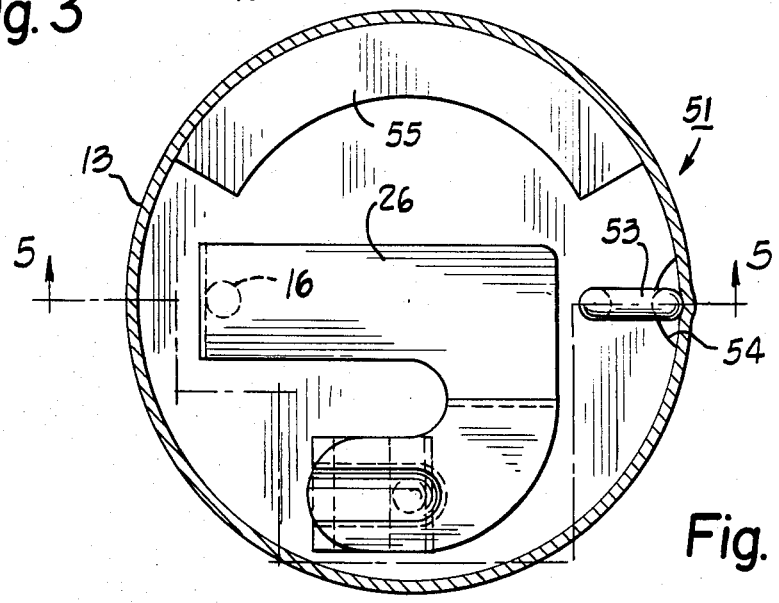
FIG. 4 is a plan view of the thermostat of FIG. 5, with the cap sectioned and thermostatic disc removed.
Figure 5:
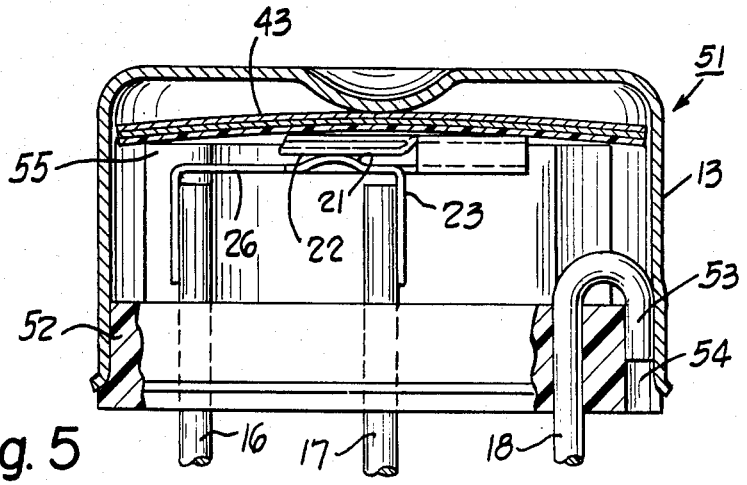
FIG. 5 is a broken, sectional view of a modified form of thermostat taken along line 5—5 of FIG. 4.

FIGS. 4 and 5 show a modification of the invention of a thermostat 51 having the same cap 13 but an insulator base 52 rather than the metal base 12. This insulator base 52 carries the same three terminals 16, 17, and 18; however, the inner end 53 of the terminal 18 is bent over into a groove 54 in the base 52 in order that the inner end 53 may engage and ground the cap 13. A partially cylindrical boss 55 is mounted on the insulator base 52.

The boss 55 is unitary with the base 52, and is sufficiently high to support a 120° segment of the thermostatic disc 43; hence, it acts as the two supports 39 and 40 in the embodiment of FIGS. 1-3.

This thermostat 51 is one which need not be hermetically sealed, but instead the cap 13 may be secured in a suitable manner, e.g., by adhesive, to the insulator base 52.

The fact that the contact strip 26 is welded at 24 to the terminal 16 permits a maximum length of the contact strip to be resilient and stressable by the thermostatic disc 43. Such effective length of the contact strip is even longer than it would be if the contact strip were to be welded to the top end of the terminal 16, and hence the maximum usable length of the contact strip 26 is achieved by this construction.

An important feature of the invention is the fact that there is a multiplication of distance of movement of the contact 22 relative to contact 21. This is established by actuation of the contact by an edge of the thermostatic disc 43, with generally the opposite edge being held in a fixed position and the central region being held in a fixed position by the convex projection 46. This permits the thermostat 11 to have good voltage and current ratings despite the small physical size of the thermostat and of the thermostatic disc 43. Where this thermostat is used in its designed end use, namely, the protection of semiconductor circuits, the voltage used may be 5-12 volts as a typical voltage range. For this low voltage, a good contact pressure is required, and this is established by the closing force of the contacts from the thermostatic disc 43.

The fact that the entire length of the contact strip 26 is resilient and is deflected by the action of the thermostatic disc 43, establishes that the contact strip can be deflected through its life cycle of at least 100,000 cycles without metal fatigue, even though this contact strip is very short, e.g., 0.250 to 0.300 inches long. This would not be the case with the typical prior art construction, which had stiffening ribs in a large proportion of the length of the contact strip. In such case, the deflection would all occur at the "hinge" portion of such deflectable contact strip, and metal fatigue could easily occur.

The fact that the cap 13 is made of metal, e.g., nickel, provides a good heat transfer path from the cap 13 via the convex depression 46 to the thermostatic disc 43. If the thermostat 11 is mounted on a heat sink, for example, it can readily sense the temperature thereof and pass such temperature condition to the thermostatic disc 43.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A thermostat comprising, in combination:

a base;

a metal cap mounted on said base to form an enclosure therewith;

first and second terminals mounted on said base in a manner insulated from each other and each having one end extending into said enclosure;

a fixed contact on said one end of said first terminal;

a resilient contact strip having a mounting end and a contact end;

means mounting said mounting end on said one end of said second terminal within said enclosure;

a movable contact on said contact end of said contact strip and adapted to cooperate with said fixed contact;

said contact strip having a resilient bias away from said fixed contact;

first and second supports on said base;

a thermostatic snap element having two positions of stability mounted on said two supports and on said contact end of said contact strip for a three-point support; and a convex projection on the inside of the top of said cap adapted to engage a convex central region of said thermostatic snap element in one temperature condition thereof to establish contact pressure forcing said movable contact against said fixed contact, and whereby upon temperature change beyond a predetermined temperature said thermostat will snap to a condition concave toward the inside of said cap for an open circuit condition of said contacts as established by the resiliency of said contact strip.

2. A thermostat as set forth in claim 1, wherein said base is a metal base hermetically sealed to said metal cap..

3. A thermostat as set forth in claim 1, wherein said thermostatic snap element is a disc and said contact strip is curved along its length to have an effective length greater than the diameter of said thermostatic disc.

4. A thermostat as set forth in claim 1, including a U-shaped metal bracket having the bight of the U-shape secured to said base and having upstanding legs the ends of which terminate in said first and second supports.

5. A thermostat as set forth in claim 1, wherein said thermostatic snap element is a disc; and an insulator disc positioned between said thermostatic disc and said three-point support.

6. A thermostat comprising, in combination:

a base;

a fixed contact mounted on said base;

a resilient contact strip having a mounting end and a contact end;

means mounting said mounting end of said contact strip on said base in a manner insulated from said fixed contact;

a movable contact mounted on said contact end of said contact strip and adapted to cooperate with said fixed contact;

said contact strip having an inherent bias away from said fixed contact;

a thermostatic snap element having two positions of stability and mounted relative to said base and having at least a two-point support near the perimeter of one surface thereof with one point of said support being the contact end of said contact strip; and fixed abutment means carried on said base and acting against the central convex region of the other surface of said thermostatic snap element to establish said movable and fixed contacts in the closed contact condition at temperatures on one side of the operating temperature range of the thermostat, said closed contact condition being established by the force of the edge of said bimetallic element against the bias of said contact strip.

7. A thermostat as set forth in claim 6, wherein said contact strip is constructed and is actuatable such that substantially the entire length of said strip bends.

8. A thermostat as set forth in claim 6, wherein said one point of support of said thermostatic snap element is outboard of said movable contact on said contact strip.

9. A thermostat as set forth in claim 6, wherein said base is a metal base.

10. A thermostat as set forth in claim 9, including a metal cap secured to said base and defining therewith an enclosure for the thermostat, said fixed abutment means being on the inside of said cap.

11. A miniature thermostat having a first contact mounted on a base and a resilient contact strip with a mounting end on the base and a movable contact mounted on the opposite contact end, a thermostatic snap element having two positions of stability mounted relative to said base and having at least a two-point support near the perimeter of one surface thereof, and fixed abutment means carried on said base and acting against the central region of the other surface of said thermostatic snap element;

the improvement comprising: substantially the entire length of said contact strip outboard of said mounting means being resilient and deformable;

one point of said support of said thermostatic snap element being the contact end of said contact strip to bend substantially the entire length of said contact strip by an edge of said thermostatic snap element; and one position of stability of said thermostatic snap element urging said contacts closed against the spring bias of said contact strip.

12. A miniature thermostat as set forth in claim 11, wherein said contact strip is in a J-shape.

13. A miniature thermostat as set forth in claim 12, wherein said contact strip has a long leg as the mounting end of the strip.

14. A miniature thermostat as set forth in claim 11, wherein said contact strip has an effective length substantially no greater than 0.25 inch.

15. A miniature thermostat as set forth in claim 11, wherein said two points of support are on opposing semicircles of said perimeter.

16. A miniature thermostat as set forth in claim 11, including a third point of support for said thermostatic snap element with each point of support being in a different 120° arc of said perimeter.

17. A miniature thermostat as set forth in claim 11, wherein said one point of support is the contact end of said contact strip outboard of said contact mounted thereon.

18. A miniature thermostat as set forth in claim 17, wherein said one point is on the surface of said contact strip opposite to the surface mounting said movable contact.

19. A miniature thermostat as set forth in claim 11, including a metal cap secured on said base and defining therewith an enclosure for the thermostat, said metal cap having said fixed abutment means thereon.

* * * * *